United States Patent [19]

La Vange

[11] Patent Number: 4,776,475

[45] Date of Patent: Oct. 11, 1988

[54] CHILD RESISTANT DISPENSING CLOSURE

[75] Inventor: Donald La Vange, Cumberland, R.I.

[73] Assignee: Polytop Corporation, Slatersville, R.I.

[21] Appl. No.: 139,745

[22] Filed: Dec. 30, 1987

Related U.S. Application Data

[63] Continuation-in-part of Ser. No. 32,562, Apr. 1, 1987, Pat. No. 4,718,567.

[51] Int. Cl.[4] ..... B65D 55/02

[52] U.S. Cl. ..... 215/216; 215/206; 215/237; 215/224; 215/211; 222/153

[58] Field of Search ..... 215/206, 211, 216, 224, 215/237, 225; 222/153

[56] References Cited

U.S. PATENT DOCUMENTS

| | | | |
|---|---|---|---|
| Re. 29,793 | 10/1978 | Pehr | 222/153 |
| 3,623,622 | 11/1971 | Sullivan | 215/216 |
| 3,627,160 | 12/1971 | Horvath | 215/224 |
| 3,850,327 | 11/1974 | Robinson | 215/225 |
| 4,022,352 | 5/1977 | Pehr | 222/153 |
| 4,244,495 | 1/1981 | Lorscheid et al. | 222/153 |
| 4,376,497 | 3/1983 | Mumford | 222/153 |
| 4,533,058 | 8/1985 | Uhlig | 215/216 |
| 4,573,599 | 3/1986 | Fillmore | 215/225 |

*Primary Examiner*—George T. Hall

*Attorney, Agent, or Firm*—Karen M. Gerken; Martin P. Hoffman; Mitchell B. Wasson

[57] ABSTRACT

A child resistant dispensing closure of the type comprising a cap member and a spout member. The cap member is provided with an exterior skirt, a top surface having an elongated groove formed therein, and an interior skirt. The interior skirt is provided with a cap locking bead adapted to engage a container locking bead provided on the neck of a container for rotatably mounting the cap member on the neck of the container. The elongated groove has a dispensing opening and an open area formed therein, and the interior skirt is provided with an interruption at the location of the open area so as to maintain the area unobstructed. The container locking bead is also provided with an interruption. The spout member includes an elongated body having a longitudinal dispensing passage therein and adapted to be mounted at one end in the elongated groove for rotation with respect to the cap member. The spout member is provided with a depending locking prong adapted for insertion into the open area. The spout member is adapted to assume an open position wherein the spout member is oriented vertically with respect to the cap member and the dispensing opening and longitudinal passage are in communication. The spout member is capable of being rotated from the open position downwardly toward the cap member to achieve a closed position wherein the locking prong is received within the open area of the cap base member and the interruption in the container locking bead.

17 Claims, 6 Drawing Sheets

CHILD RESISTANT DISPENSING CLOSURE

This application is a continuation-in-part of applicant's co-pending U.S. Patent Application Ser. No. 32,562, filed 4-1-87, now Pat. No. 4,718,567, directed to a Child Resistant Dispensing Closure.

BACKGROUND OF THE INVENTION

1. Field of the Invention

The invention pertains generally to a child resistant dispensing closure adapted to be associated with the neck of a container, bottle or other like receptacle. More particularly, the invention of applicant's co-pending application relates to a child resistant dispensing closure of the type comprising a cap base member and a cap lid member mounted upon the cape base member so as to be capable of assuming a closed position, wherein the contents of the container are prevented from passing through the dispensing closure, and an open position, wherein the contents are allowed to pass through the dispensing closure. According to the principles of the invention, the cap lid member is provided on the neck of the associated container in the closed position of the dispensing closure so as to positively secure the cap lid member in said closed position. The open position of the dispensing closure may be achieved only by manuel manipulation of the dispensing closure in a series of separate dissimilar motions. The provision of the locking prong on the cap lid member and the locking means on the container neck, as well as the requirement for a combination of diverse actions in order to operate the dispensing closure, effectively precludes a child from gaining access to the contents of the container to which the dispensing closure is attached.

The invention of the present application further involves utilization of the foregoing principles on a dispensing closure of the type comprising a cap member and a rotatable spout member operatively associated therewith. The latter type of dispensing closure is characterized in that the spout member is adapted to be mounted in an elongated groove in the cap member such that the spout member is capable of assuming a closed position, in which an opening formed in the cap member is closed off by the spout member, and is adapted for rotation from the closed position to an open position wherein the opening in the cap member is in communication with a passage provided in the spout member, thereby allowing the contents of the associated container to pass through the opening and the passage. Pursuant to the present invention, the spout member is intended to be formed with a locking prong for engaging locking means provided on the neck of the associated container in the closed position of the dispensing closure so as to positively secure the spout member in the closed position. The open position for this type of dispensing closure is similarly achieved only by manual manipulation of the dispensing closure in a series of dissimilar motions.

The term "dispensing closure" is commonly utilized to designate closures which are normally adapted for attachment to the necks of containers such as bottles, tubes, or the like. Such dispensing closures, as are commonly known, generally include a cap base member adapted to be secured to or formed integral with a container and a cap lid member which is mounted on the cap base member for movement between open and closed positions. In the open position, material can be moved through an opening in the cap base member, while in the closed position such opening is closed off or sealed.

It has been previously recognized that the utility of a dispensing closure in many different types of applications can be enhanced or improved by constructing such a closure so that the cap lid member is normally held in an open position once it has been moved into such position, until such time as deliberate force is applied by the user to close such a cap lid member.

Various expedients and structures have been utilized in the prior art in order to obtain the foregoing attributes. Examples of dispensing closures of this type are found in U.S. Pat. No. 4,172,540 and in U.S. Pat. No. 4,220,248. U.S. Pat. No. 4,172,540, issued on Oct. 30, 1979 to Erichson, discloses a dispensing closure having a cap base and a lid mounted thereon by means of a spring. The spring serves to hold the lid relative to the top of the cap base so that the lid is held against movement when in the open position. U.S. Pat. No. 4,220,248, issued on Sept. 2, 1980 to Wilson et al, is directed to a closure member and lid wherein a spring structure and a cam structure cooperate to hold the lid in an open or closed position.

The latter dispensing closure structures are considered to be highly desirable from a utilitarian standpoint in that the cap lid member is prevented from interfering with the discharge of material through such closures. Additionally, dispensing closures as so described may be easily and conveniently manufactured at a nominal cost and are of such a character that they afford facility of use over a prolonged period. Moreover, these dispensing closures are advantageous because of their simplicity, because the manner in which they are constructed makes it possible to utilize them without danger of damage during handling, installation and the like, and because they are aesthetically satisfying.

Dispensing closures which posses similar attributes are typically characterized by a cap member having a rotatable or pivotable spout member mounted thereon in an elongated groove. The spout member, in the closed position of the dispensing closure, rests against the cap member and effectively closes off or blocks a dispensing opening formed in the cap member, thereby preventing release of any potentially harmful contents of the container upon which the cap member is mounted. The spout member is adapted to be manually grasped at one end and rotated or pivoted upwardly with respect to the cap member for purposes of bringing a longitudinal passage formed in the spout member into alignment with the dispensing opening formed in the cap member. In the latter open position for the dispensing closure, the contents of the associated container are able to pass through the aligned opening and passage.

While the attributes of the foregoing dispensinng closures are numerous, the need exists to provide such closures with an effective means for preventing unwanted access to potentially harmful contents of the container with which the closure is associated. The need for dispensing closures with child resistant features is precipitated by the extensive home and personal usage and consumption of potentially injurious substances such as medicaments, pharmaceuticals, cosmetics, cleaning preparations and the like. Thus, the need exists for a dispensing closure that not only possesses the diverse attributes discussed above, but which is capable of being positively and securely locked in the closed position so that comparatively young children or those of below-average mental capacity cannot open it under normal circumstances. The dispensing closure must be relatively difficult to open so as to remain impenetrable to the often rigorous stresses and forces imposed upon it by an inquisitive and determined child. However, the dispensing closure must also be sufficiently easy to open so that it may be operated by individuals of average mental capacity, even if such individuals do not possess what may be regarded as normal physical strengths.

Previous attempts to provide dispensing closures of a child resistant character have often resulted in structures which, due to their complexity, were prohibitively expensive to manufacture for commercial utilization. Additionally, complicated construction often rendered the closure difficult to operate, even by an adult, requiring highly complicated manipulations and/or considerable force. Those closures wherein the child resistant feature depends upon the application of relatively great strength are particularly flawed in that a small child may be stronger than an elderly person or someone weakened by illness, and the closure, therefore, inevitably fails to fulfill its child resistant purpose. The child resistant features which require unusually complex manipulations are, in reality, impractical to use and are destined to fail in gaining commercial acceptance. The more simple structures which have been adopted have generally proved to be disappointing in responding to child resistant demands, being easily penetrable, deliberately or inadvertently, by an average child.

Indeed, a dispensing closure utilizing a spout member which is rotatably mounted in a cap member is particularly vulnerable. A significant drawback to such a dispensing closure is that a child who has gained access to the closure is apt to exert either a vertical force, or a force having a predominantly vertical component, on the spout member. When this occurs, the spout may be rotated to some extent, a situation that is almost certain to further arouse the curiousity of the child and result in additional exploration and manipulation of the spout member. Consequently, the probability that the spout member will be rotated to the open position becomes dangerously high.

Applicant's co-pending U.S. Patent Application Ser. No. 32,562 addresses the foregoing problems and deficiencies for a dispensing closure characterized by a cap base member and a cap lid member. More specifically, the invention which is the subject of applicant's prior application provides a dispensing closure wherein the cap lid member is capable of being locked with respect to the neck of the attached container in the fully closed position of the dispensing closure and wherein the unlocked position of the dispensing closure is made possible only by manual rotation of the dispensing closure with respect to the associated container from the locked position, so as to assume a specific limited position in which a locking prong on the cap lid member is disengaged from the neck of the container. The cap lid member is then able to be manually moved from the closed but unlocked position upwardly with respect to the cap base member to the fully open position wherein a dispensing opening provided in the cap base member is unobstructed, allowing the contents of the container to be dispensed therethrough. The cap lid member is normally maintained in the fully open position so as not to interfere with the dispensing of the container contents until such time as it is manually moved downwardly toward the cap base member to close or seal off the dispensing opening. The locking prong on the cap lid member is then engaged with the locking means on the neck of the associated container, thereby securing the dispensing closure against unwanted opening by a child.

The invention which is the subject of the present application overcomes the various aforementioned disadvantages as they relate to a dispensing closure characterized by a cap member having a rotatable spout member mounted thereon. The present invention provides a dispensing closure wherein the spout member is capable of being locked, by means of a locking prong, with respect to the neck of the container to which the cap member is attached when the spout member is in the closed position. The open position for the spout member is achieved only by manual rotation of the cap member with respect to the container from the closed position, so that the cap member assumes a specific well defined position in which the locking prong on the spout member is no longer in engagement with the container neck. The spout member is able to then be manually rotated or pivoted upwardly with respect to the cap member from the latter closed, but unlocked, position to the fully open position wherein a dispensing opening provided in the cap member is aligned with or otherwise in communication with a dispensing passage formed in the spout member. With the dispensing opening in the cap member so aligned with the passage in the spout member the contents of the container may be dispensed therethrough. The spout member, being securely retained in a groove in the cap member, normally maintains the open position until such time as it is manually rotated or pivoted downwardly toward the cap member so as to interrupt communication between the dispensing opening in the cap member and the passage in the spout member. The closed position for the dispensing closure is obtained by the user causing the cap member to assume the specific position with respect to the container neck wherein the locking prong on the spout member enters a slot provided in the cap member. The closed and locked position for the dispensing closure is then able to be achieved by manually rotating the cap member with respect to the container neck so that the cap member and the container are no longer arranged in the aforementioned specific position. With this well defined, limited position no longer assumed, the locking prong is in locking engagement with the neck of the container and the spout member is effectively and positively secured against inadvertant opening by a child.

The provision of a specific unlocked position for the dispensing closure with respect to the container neck, which unlocked position is available at only a very limited location, addresses the almost universal reaction exhibited by children in attempting to remove a closure from a container. More specifically, a child who is presented with the opportunity to explore a closed container will inevitably twist and rotate the attached closure in an effort to free the closure from the container, or will attempt to separate the closure from the container by pulling the respective parts directly apart. Removal of the dispensing closure by rotation is prevented, due to the fact that the dispensing closure is positively secured to the neck of the container. The latter instinctive pulling motion is likewise ineffective to achieve opening of the dispensing closure of the present invention because the cap member is positively and frictionally engaged with the neck of the associated container and cannot be pulled therefrom, even with the application of great force normally not possessed by a child. Additionally, the spout member is able to be rotated or pivoted with respect to the cap member only when the dispensing closure is specifically disposed with respect to the neck of the container in the unlocked position.

This unlocked position is very limited, with all other positions of the dispensing closure being locked positions, and is achieved only by exact rotation of the dispensing closure with respect to the neck of the container, thus requiring a degree of intellectual acuity beyond the ken of the normal child. A normal child is manifestly incapable of exercising the reason and intellect that is essential for accurately and properly rotating the dispensing closure to assume the unlocked position and thereafter, in an entirely dissimilar motion, to rotate the spout member with respect to the cap member. The manipulations characteristic of a child are inconsistent and random at best, thereby effectively precluding the possibility that such individual could inadvertently or accidentally discover the unlocked position of the dispensing closure given the opportunity to manually rotate the closure with respect to the container.

Even were the unlocked position accidentally achieved and maintained, through lengthy and persistent rotation of the closure, actual opening of the spout member is possible only by thereafter applying a diverse force sufficient to upwardly pivot the spout member to the extent where the passage in the spout member is in communication with the opening in the cap member. This requirement for a secondary dissimilar action virtually insures against unwanted operation of the instant dispensing closure by a child, in that a child is inherently incapable of engaging in the sophisticated mental and physical steps involved in making the transition from a manual rotational action to a second, manual pivoting action. Indeed, the impatient nature of the typical child is likely to cause the child to abandon its unsuccessful efforts at twisting the dispensing closure in an effort to free it from the container after only a short while. The child can then be expected to utilize his teeth for purposes of prying the cap lid member from the cap base member. The instant dispensing closure is capable of rendering the latter efforts similarly ineffectual due to the fact that the spout member is lockingly engaged with the neck of the attached container in all rotational positions of the dispensing closure, except for the one very limited unlocked position. The possibility that a child could inadvertently discover the specified unlocked position by rotating the closure, and then accidentally pivot the spout member by utilizing his teeth, or by applying a downward force component to the mounted end of the spout, is highly remote and, indeed, negligible. The series of movements required for operation of the present dispensing closure, intentional or otherwise, demand such coordination, dexterity and mental skill as are normally beyond the realm of capabilities of the ordinary child.

2. Description of the Prior Art

It is generally known in the prior art to provide a dispensing closure with a locking member which is adapted to engage an internal portion of the base portion of the closure in the closed or sealed position of the dispensing closure.

For example, U.S. Pat. No. 3,603,470, issued on Sept. 7, 1971 to Armour, discloses a safety closure comprising an overcap having locking means which engages a groove located on the inner surface of the skirt of the closure. The locking means is released when an outwardly flaring section of the skirt is manually pressed.

U.S. Pat. No. 3,623,622, issued on Nov. 30, 1971 to Sullivan, shows a cap lid having a downwardly extending arm adapted to engage within an aperture in the wall of the base portion of the closure. The arm is withdrawn from the aperture when a lock disc on the lid is rotated.

It is also known in the prior art to provide a closure wherein locking means provided on a lid or cap member is adapted to engage an external portion of a closure base member. For example, U.S. Pat. No. 4,022,352, issued on May 10, 1977 to Pehr, is directed to a safety closure having a closure member provided with a latch member adapted to engage a portion of the exterior surface of a cap member. See also, U.S. Pat. No. Re 29,973, issued on Oct. 3, 1978 to Pehr as a reissue of U.S. Pat. No. 4,022,352.

Similarly, U.S. Pat. No. 4,533,058, issued on Aug. 6, 1985 to Uhlig discloses a dispensing closure wherein a locking flap provided on the cap portion is adapted to be lockingly received in a recess formed in the skirt of the body portion. The closure is adapted to be opened by depressing the free end of the locking flap.

U.S. Pat. No. 4,629,081, issued on Dec. 16, 1986 to McLaren shows a closure having a cap, the locking bead of which is adapted to engage a trigger provided on the inner cap. Actuation of the trigger permits disengagement of the locking bead.

Moreover, the prior art teaches the concept of providing a closure wherein the lid carrier is formed with an opening for reception of a locking member provided on the lid. In particular, U.S. Pat. No. 4,244,495, issued on Jan. 13, 1981 to Lorscheid et al, teaches a safety closure including a lid and lid carrier, wherein the lid is provided with a locking member for reception and engagement within an opening in the lid carrier. The lid may be released by application of a manual force to a pressure surface on the lid carrier.

Additionally, the prior art teaches a variety of dispensing closures wherein locking means formed on the skirt of the closure engages with the associated container, whereby rotational movement of the closure is required in order to disengage same from the container.

An example of this type of closure is shown in U.S. Pat. No. 4,573,599, issued on Mar. 4, 1986 to Fillmore. Disclosed therein is a closure cap having a locking lug formed on the skirt of the cap for engagement with a retaining bead formed on the container. The closure cap is adapted to be removed by rotating the cap such that the locking lug is in alignment with a notch formed in the retaining bead.

Similarly, U.S. Pat. No. 4,071,156, issued on Jan. 31, 1978 to Lowe, is directed to a closure cap which has a series of locking lugs adapted to engage under a locking rib formed on the container neck in all positions except one, the cap being able to be freed from the container in said one position wherein the locking lugs are aligned with gaps formed in the locking rib.

Additionally, U.S. Pat. No, 3,980,194, issued on Sept. 14, 1976 to Costa discloses a cap having a skirt which is provided with a plurality of lugs adapted to underly a rib formed on the container neck. The cap is adapted to be removed by rotating the cap such that one of the lugs is brought into alignment with a flattened portion of the rib.

U.S. Pat. No. 3,627,160, issued on Dec. 14, 1971 to Horvath, teaches a safety cap rotatably mounted on the neck of a container and having a lug for locking reception beneath a rib formed on the neck. The cap may be removed when the lug is brought into registry with a gap in the locking rib.

It is further known in the prior art to provide a closure wherein the cap part is provided with locking means which engages the container and which is released by rotational movement. More specifically, U.S. Pat. No. 4,449,639, issued on May 22, 1984 to Davis is directed to a child resistant closure including a cap part provided with a lug for engaging an external projection on the rim of the container. Disengagement of the lug from the projection is accomplished by rotation of the cap part.

Finally, the prior art discloses dispensing closures of the general type wherein a cap is adapted to be mounted on the neck of a container, and a spout is mounted on the cap for movement between an open and closed position. It is also known in the prior art to provide dispensing closures of this general type with means which renders the closure child resistant.

For example, U.S. Pat. No. 3,957,181 to Hazard utilizes a spout provided with structure located so as to be capable of being engaged by an implement applied from above the closure so that force exerted through the implement will rotate the spout to a sufficient extent whereby it can in turn be manually engaged for further rotation to a vertical position.

U.S. Pat. No. 4,081,113 to Hazard teaches a spout having an engagement structure, such as a notch, located so that a vertically directed force exerted against the engagement structure does not move the spout from the closed position.

Additional examples of dispensing closures characterized by a pivotable spout can be found in U.S. Pat. No. 3,884,392 to Hazard; U.S. Pat. No. 2,863,818 to Hazard; and U.S. Pat. No. 3,851,805 to Hazard.

The prior art fails to teach or suggest a child resistant dispensing closure having a cap member which is positively and securely associated with a container and which is operatively associated with a spout member having locking means, in the form of a locking prong, which, in the closed position of the closure, is adapted to be received within a slot formed in the cap member and is adapted to engage a locking bead formed on the container. The prior art further fails to disclose a dispensing closure of this type wherein the spout member may be rotated to the open, or dispensing, position of the closure only when the locking prong is brought into alignment with a gap or interruption formed in the locking bead by rotating the closure with respect to the container, the locking prong being engaged beneath the continuous portion of the locking bead in all other positions of the closure.

SUMMARY OF THE INVENTION

Applicant's co-pending patent application Ser. No. 32,562 is directed to a child resistant dispensing closure of the type comprising a cap base member and a cap lid member. The cap base member is defined by a top surface, an exterior depending skirt and an interior depending skirt. A dispensing opening is formed in the top surface, which is provided with a peripheral recessed shoulder. Additionally, a slot is provided in the top surface proximate the recessed shoulder. According to a preferred embodiment of the invention, an integral hinge member extends from the cap base member, at a location opposite the slot, to the cap lid member.

The interior skirt is provided with an interruption at the location of the slot, with the generally continuous portion of the interior skirt extending from proximate one end of the slot to proximate the other end, so as to leave the slot unobstructed. A peripheral cap locking bead is provided on the continuous portion of the interior skirt for frictional engagement with a peripheral container locking bead provided on the neck of a container intended to be associated with the dispensing closure. The container locking bead is provided with an interruption, generally equal in length to the length of the slot. The frictional engagement between the cap locking bead and the container locking bead allows the cap base member to be rotated with respect to the neck while preventing removal therefrom.

First external indicia means, preferably in the form of an arrow, is provided on the exterior skirt of the cap base member at the location of the slot. Second external indicia means, also preferably in the form of an arrow, is provided on the neck at the location of the interruption in the container locking bead.

The cap lid member is defined by a cap top and a dependent cap skirt having a peripheral edge. A resilient locking prong which terminates in a hook-like end member extends from the interior surface of the cap top and is adapted to be received within the slot provided in the cap base member. According to the preferred embodiment, means, which may be in the form of cam lugs, are provided on the cap lid member on each side of the hinge member for cooperation with cam surface means similarly provided on the cap base member. The cam lugs and cam surface means cooperate to positively maintain the cap lid member in the open position, wherein the dispensing opening is unobstructed, so as not to interfere with the dispensing of the contents of the container until such time as the cap lid member is deliberately moved to the closed position by the user.

The cap lid member is adapted to be moved from the open position to a closed and locked position by the user moving the cap lid member downwardly toward the cap base member around the hinge member, such that the locking prong is caused to enter the slot in the cap base member. The locking prong, due to its resilience, is able to enter the slot by deflecting around the continuous portion of the container locking bead with the hook-like end member engaging under the container locking bead. In the closed and locked position, the cap lid member closes off the dispensing opening and the peripheral edge of the cap skirt abuts the recessed shoulder on the cap base member. When the locking prong is fully inserted, the cap lid member is positively and securely retained with respect to the container neck in a closed and locked position.

The cap lid member is adapted to thence assume the open position by the user manually rotating the cap base member with respect to the neck so as to align the arrow on the base member with the arrow on the neck. The latter position, corresponding as it does to alignment of the slot and, hence, the locking prong, with the interruption in the container locking bead, allows the locking prong to be removed from the slot when the user manually lifts the cap lid member away from the cap base member to the open position.

An alternative embodiment of the invention disclosed in applicant's co-pending application contemplates forming an additional cap locking bead on the interior skirt of the cap base member for frictional engagement with a corresponding additional container locking bead on the neck of the container. These additional locking beads are intended to be generally continuous, thereby securing the cap base member to the neck of the container in a manner which affords maximum hoop strength.

A second alternative embodiment for the dispensing closure, as further disclosed in applicant's co-pending application, involves forming the cap lid member integral with a spring but separate from the cap base member.

The invention of the present application is directed to a child resistant dispensing closure of the type comprising a cap member and a spout member. The cap member is defined by a top surface having an elongated groove formed therein, an exterior depending skirt, and first and second interior depending skirts. The elongated groove is defined by a pair of side walls, a rear wall and a recessed surface. A vertical opening is formed in the recessed surface of the elongated groove, leading into the interior of the cap member. The cap member is provided with an open area in the elongated groove extending between a terminal edge of the recessed surface and the side wall of the cap member. The first interior skirt is interruped or broken at the location of the open area so as to maintain the open area unobstructed.

A peripheral cap locking bead is provided on the continuous portion of the first interior skirt for frictional engagement with a peripheral container locking bead provided on the neck of a container which is adapted to have the cap member mounted thereon. The container locking bead is provided with an interruption, generally equal in width to the width of the open area. The frictional engagement between the cap member and the container locking bead allows the cap member to be rotated with respect to the neck while preventing removal therefrom.

The spout member is adapted to be rotatably mounted within the elongated groove formed in the cap member by means of trunions provided on a first end of the spout member being received within bearing cavities formed in the side walls of the elongated groove. The bearing cavities possess a horizontal axis which is aligned with the vertical axis for the vertical opening formed in the recessed portion of the groove. The spout member is provided with a longitudinal passage.

The spout is further provided with a locking prong which depends vertically from its bottom surface. The spout member is adapted to assume a closed position wherein the bottom surface of the spout member rests snugly against the recessed portion of the cap member so as to close off and seal the open area, as well as the vertical opening formed in the elongated groove. The latter closed position is able to be achieved by the user manually rotating the cap member with respect to the neck of the container so that the interruption in the container locking bead is aligned with the open area. The aforementioned alignment allows the locking prong to be fully inserted through the open area and into the interuption in the container locking bead.

From the closed position, the dispensing closure is able to assume a closed and locked position by the user further rotating the cap member with respect to the neck of the container so that the interruption and the open area are no longer aligned. The closed and locked position is characterized by the open area being aligned with a continuous portion of the container locking bead such that a hook-like end member provided on the locking prong is lockingly engaged with the container locking bead.

The fully open position for the dispensing closure is obtained by the user first rotating the cap member from the closed and locked position to the closed but unlocked portion as previously described, and then manually grasping an extension provided on the spout member overlying an indented portion of the side wall of the cap member. The spout member is adapted to then be rotated or pivoted upwardly with respect to the cap member until the vertical opening in the elongated groove is aligned with the longitudinal passage in the spout member. The contents of the container are able to be dispensed through the aligned passage and opening.

DETAILED DESCRIPTION OF THE PREFERRED EMBODIMENT

Figure 1:
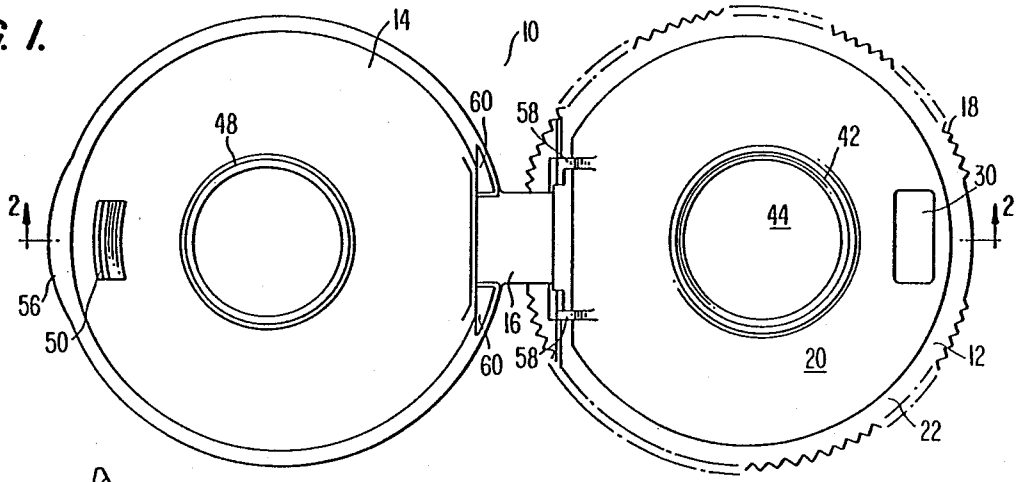
FIG. 1 is a top plan view of the dispensing closure of applicant's co-pending application showing the dispensing closure in the fully open position.

A preferred embodiment for one type of child resistant dispensing closure, which is the subject of applicant's co-pending Patent Application Ser. No. 32,562, is shown in particular in FIGS. 1-5, being indicated generally by the reference numeral 10. The dispensing closure is constructed as a unitary body by conventional injection molding techniques out of any one of a wide variety of known, somewhat flexible, somewhat resilient, polymer materials. Various polyolefins, such as polyethylene or polypropylene, may be effectively utilized.

The child resistant dispensing closure comprises a cap base member 12 which is connected to a cap lid member 14 by means of an integral, so-called "living" hinge 16. The cap base member is defined by a first generally cylindrical exterior depending skirt 18 and a top surface 20. An annular recessed shoulder 22 is provided around the periphery of the top surface 20 between the top surface and the exterior skirt 18.

As is best depicted in FIGS. 2, 3, 4, 6 and 7, a second generally cylindrical interior depending skirt 24 extends downwardly from the top surface, spaced from and concentric with exterior skirt 18. This interior skirt is not continuous, however, but is interrupted at 26 in FIGS. 6 and 7, at which point the interior skirt diverges into interior skirt portions 28 which merge with the exterior skirt 18. A generally rectangular slot 30 is provided in the top surface 20 of the cap base member at the location of interruption 26 of the interior skirt 24, extending generally between skirt portions 28.

With particular reference to FIGS. 2, 3, 4, 6 and 7, the interior skirt 24 is provided with means, in the form of a peripheral cap locking bead 32, for securing the interior skirt to the neck 34 of a container (not shown). As can best be seen in FIG. 3, the cap locking bead 3 is provided on the continuous portion of interior skirt 24, but it not provided on the skirt portions 28, thereby leaving the slot 30 unobstructed. The neck 34, which may be formed integral with a bottle or container, or which may be formed separately therefrom, is provided with peripheral container locking bead 36. The container locking bead 36 is adapted to be engaged with the cap locking bead 32 for purposes of positively and frictionally securing the cap base member upon the neck 34, while allowing the cap base member to be rotated with respect to the neck. The cap locking bead and container locking bead are configured so as to be capable of permanent locking engagement, impenetrable to a child's efforts to pull the cap base member from the neck or to free the cap base member from the neck by twisting it relative thereto.

Figure 5:
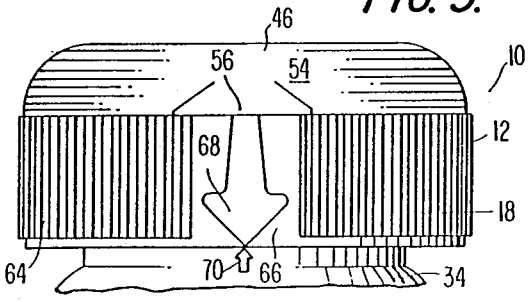
FIG. 5 is a right front view of the dispensing closure of FIG. 4.
Figure 4:
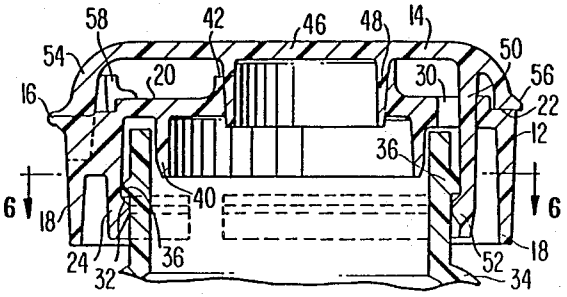
FIG. 4 is a side sectional view of the dispensing closure of FIG. 2 showing the dispensing closure in the fully closed and unlocked position.
Figure 6:
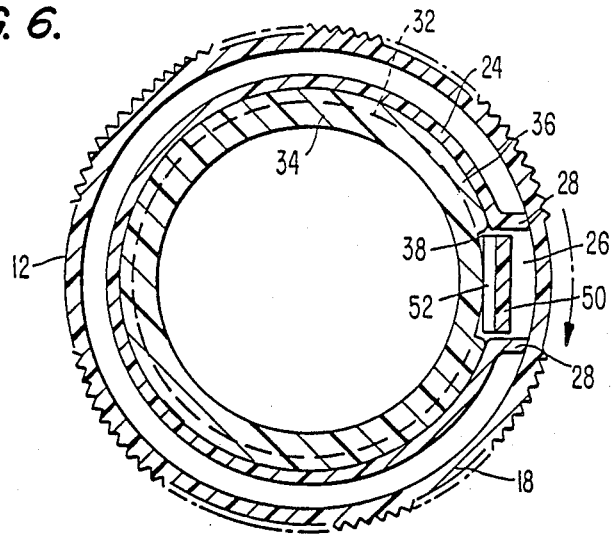
FIG. 6 is a top sectional view of the dispensing closure of FIG. 4 taken along line 6—6 and showing the dispensing closure in the fully closed and unlocked position.
Figure 7:
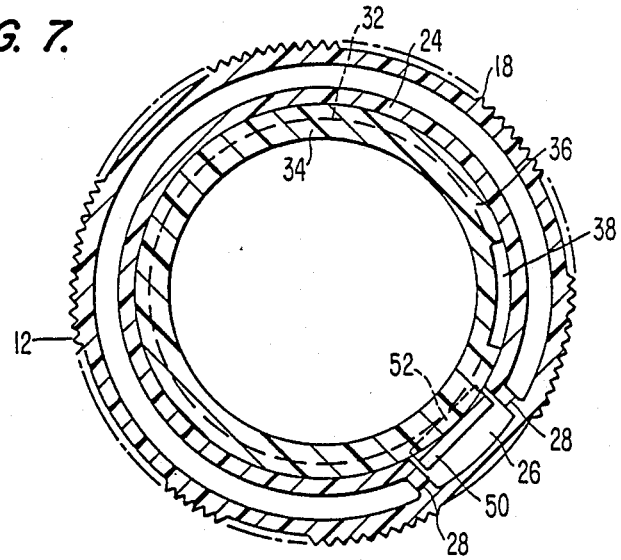
FIG. 7 is a top sectional view of the dispensing closure of FIGS. 4 and 6, showing the dispensing closure in the fully closed and locked position.

FIGS. 6 and 7 depict in section the cap base member 12 as it appears when secured to the neck 34. As is shown therein, the container locking bead is not continuous, but is provided with an interruption 38, generally equal in length to the interruption 26 in the interior skirt 24. When the cap base member 12 is secured to the neck 34 as depicted in FIGS. 4 and 5, the exterior skirt 18 defines with the container a continuous aesthetically satisfying and symmetrical configuration of an enclosed receptacle. It should be noted that other similar known means may be utilized instead of the locking beads 32 and 36 for mounting the cap base member on the neck 34.

Figure 2:
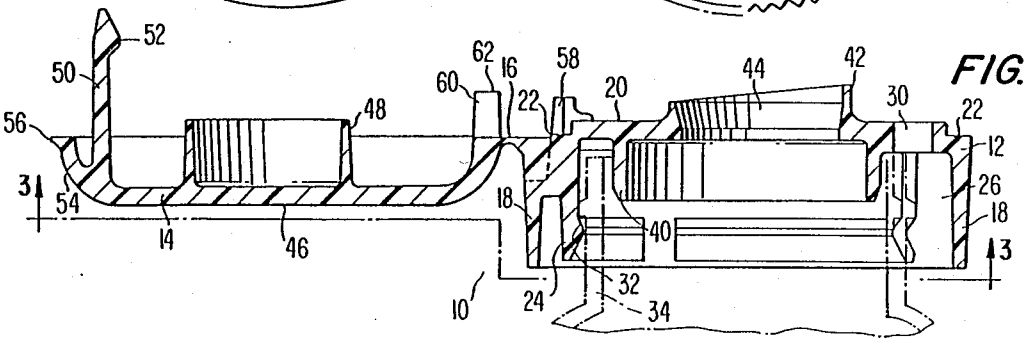
FIG. 2 is a side sectional view of the dispensing closure of FIG. 1 taken along line 2—2 and showing the neck of the associated container in phantom.

Referring to FIGS. 2 and 4, it can be seen that a dependent cylindrical sealing element 40 extends downwardly from the top surface 20 interior of and concentric with interior skirt 24. The sealing element is adapted to fit within the neck 34 of the associated container to form a seal therewith. Obviously, various equivalent sealing structures may be employed in conjunction with the dispensing closure and neck. A nozzle-like boss 42 is provided on the top surface 20 interiorly of the sealing element around an opening 44 extending through the top surface and providing communication with the interior of the associated container.

As best depicted in FIGS. 2 and 4, the cap lid member 14 includes a substantially planar top 46 which carries a plug member 48 adapted to fit within the dispensing opening 44 formed in cap base member 12 so as to close off the opening when the cap lid member is in the closed position. An integral resilient locking prong 50 extends from the interior surface of the planar top 46, generally perpendicular thereto, and terminates in a hook-like end member 52. The cap lid member is further defined by a cap skirt 54, one end of which is connected to the recessed shoulder 22 of the cap base member by means of hinge 16. The locking prong is located on the planar top of the cap lid member at the side of the cap lid member opposite hinge 16. The cap skirt 54, at the general location of the locking prong and directly opposite the hinge, terminates in an arcuate outwardly projecting lip 56.

Figure 3:
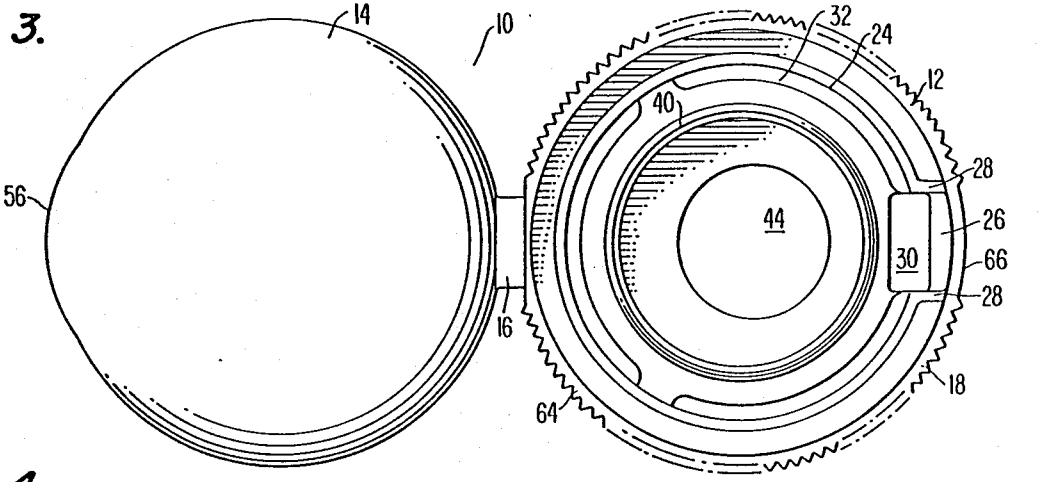
FIG. 3 is a bottom plan view of the dispensing closure of FIG. 2 taken along line 3—3.

The cap lid member 14 is adapted to be pivoted substantially about an axis (not shown) from a fully open position, as indicated in FIGS. 1, 2 and 3 extending outwardly from the cap base member 12, in which it is formed by an injection molding operation, to a fully closed position depicted in FIGS. 4 and 5. In this fully closed position, the locking prong 50 is received within the slot 30 formed in cap base member 12, with the edge of the cap skirt 54 abutting against the recessed shoulder 22 of the cap base member. The cap skirt 54 thus appears to be a continuation of the exterior skirt 18 of the cap base member, except for the lip 56, which projects slightly beyond the exterior skirt 18 of the cap base member.

Two separate, resilient upstanding posts 58, serving essentially as leaf springs, project upwardly from recessed shoulder 22 on opposite sides of hinge 16. With reference to FIGS. 2 and 4, it can be seen that the posts extend upwardly for a distance beyond top surface 20 of the cap base member. These posts are located on the cap base member such that they are capable of being engaged by cam lugs 60 provided on the cap lid member. Alternatively, the posts could take the form of vertical cam surfaces which cooperate with cam followers or lugs extending from the cap lid member, one on each side of the hinge.

Cam lugs 60 are situated on the cap lid member 14 so as to in effect constitute extensions of the cap skirt 54 on opposite sides of hinge 16. During movement of the cap lid member 14 from the fully open position of FIGS. 1, 2 and 3 to the closed position of FIGS. 4 and 5, the ends 62 of the cam lugs 60 will abut against the posts 58 so as to push upon these posts and temporarily distend them. The cam lugs 60 are dimensioned so that, as the lid reaches a closed position, the cam lugs will be located generally along side of and next to the posts 58. It should be noted that this position is "stable" in that, with the cap lid member in the closed position, the posts 58 will not be under any continuing pressure such as might cause a degree of creeping or deformation.

When the cap lid member is moved to an open position from a closed position, the ends 62 of the cam lugs 60 again abut and temporarily deform the posts 58 until such time as the cam lugs 60 are approximately perpendicular to the posts 58. The lid is thus held so that it cannot swing back toward a closed position so as to interfere with the discharge of material through the opening 44, which opening is then unobstructed in order for the contents of the container to pass therethrough.

As discussed hereinabove, the cap lid member 14 is adapted to assume the fully closed position by a user manually pivoting the cap lid member toward the cap base member 12 around hinge 16. Execution of this motion results in the locking prong 50 being caused to enter the slot 30 in the cap base member with plug member 48 being received within opening 44 so as to close off and seal the opening. The locking prong is able to freely enter slot 30 because of the interruption 26 provided in the interior skirt 24 of the cap base member at the location of the slot. Because the cap base member is capable of being manually rotated with respect to the neck 34, the slot 30 may or may not be aligned with the interruption 38 in the container locking bead 36, depending upon the rotational action, if any, to which the cap has been subjected by the authorized user while in the open dispensing position. If the slot is not in alignment with the interruption in the container locking bead, then the continuous portion of the container locking bead will project into and underlie the slot. The locking prong, because of its resiliency, can nonetheless be caused to fully enter the slot by a user manually pressing on the cap lid member so as to cause the cap lid member to be brought toward the cap base member. The locking prong will then deflect around the container locking bead until fully inserted within the slot, at which point the hook-like end member 52 of the locking prong is automatically engaged under the container locking bead. The locking prong, in the engaged position, appears in effect as a continuation of the interior skirt 24 across the interruption 26.

In the fully closed and locked position of the dispensing closure, the locking prong effectively and securely locks the cap lid member to the neck of the container such that it cannot be moved to the open position without the user engaging in further manipulation of the dispensing closure as will be discussed herein. In this fully closed and locked position, the dispensing closure possesses the structural integrity to prevent the cap lid member from being separated from the cap base member not only by the user, but by the fingers or teeth of a child. Additionally, it is virtually impossible for a child or other mentally infirm individual to free the cap base member from the container neck by rotating the cap base member in that it is frictionally and positively fit upon the neck and, therefore, cannot be removed.

If, when the cap lid member is moved to the fully closed position, the slot is in alignment with the interruption 38 of the container locking bead 36, as shown in FIG. 6, then the dispensing closure, although fully closed, will not be locked. It is, however, very simple for the user to obtain the locked position for the dispensing closure merely by rotating the dispensing closure with respect to the container neck so as to cause the slot, with the locking prong fully inserted therein, to overlie a continuous portion of the container locking bead, as depicted in FIG. 7. The hook-like end member of the locking prong will then be locked and engaged beneath the continuous portion of the container locking bead as previously discussed.

For purpose of providing an indication as to the alignment or non-alignment of the slot, and the locking prong, with the interruption in the container locking bead and, thus, the locked and unlocked positions of the dispensing closure, the exterior skirt 18 of the cap base member is provided therearound with serrations 64 which are interrupted by a smooth portion 66 at the location of the slot 30 as shown in FIG. 5. A downwardly pointing arrow 68, or other like indicia, is provided on the smooth portion. A corresponding upwardly printing arrow 70 is provided on the exterior surface of the neck 34 at the location of the interruption 38 in the container locking bead. Hence, non-alignment of the respective arrows 68 and 70 indicates the locked position for the fully closed dispensing closure.

The dispensing closure is able to be opened from the fully closed and locked position by a user first rotating the dispensing closure to the unlocked position, as indicated by the alignment of the arrows 68 and 70, and then manually pressing upwardly upon or grasping the lip 56 of the cap lid member so as to pivot the cap lid member upwardly and away from the cap base member, thereby removing the sealing plug 48 from the dispensing opening 44. Alignment of the arrows 68 and 70 indicaes alignment of the slot, and the locking prong, with the interruption in the container locking bead and thereby communicates to the authorized user the unlocked position for the dispensing closure and permits withdrawal of the locking prong from the slot.

Figure 8:
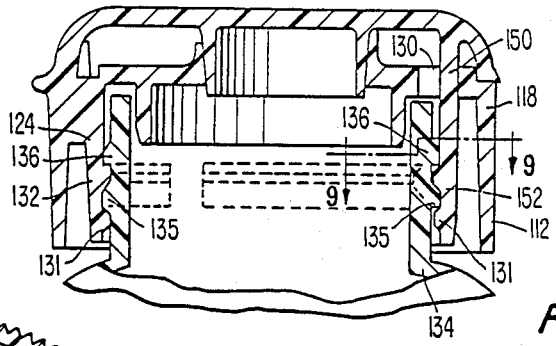
FIG. 8 is a side sectional view of a first alternative embodiment for the dispensing closure of applicant's co-pending application showing the dispensing closure in the fully closed and unlocked position.
Figure 9:
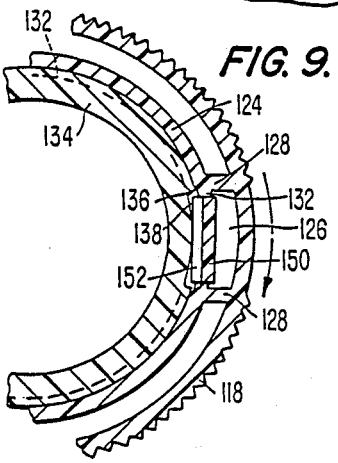
FIG. 9 is a partial top sectional view of the dispensing closure of FIG. 8 taken along line 9—9 and showing the dispensing closure in the fully closed and unlocked position.
Figure 10:
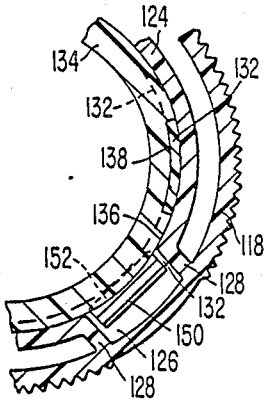
FIG. 10 is a partial top sectional view of the dispensing closure of FIGS. 8 and 9 showing the dispensing closure in the fully closed and locked position.

It can be seen that the unlocked position, corresponding as it does to complete and accurate alignment of the slot in the cap base member with the interruption in the container locking bead, is very limited. It is thus extremely improbable that a child, who lacks the mental ability to comprehend the purpose and meaning of aligning visible indicia and who lack the physical coordination and motor skills to bring such exact alignment about, will accidentally arrive at the precise location of alignment which represents the unlocked position. In light of the unfocused efforts and brief attention span characteristic of children and others of reduced mental capacity, it is most unlikely that such persons would possess the patience required to realize inadvertent achievement of the unlocked position by rotating the dispensing closure with respect to the neck of the container. Even were such person to inadvertently arrive at the unlocked position, however improbable, it would then be necessary for that person to deduce the fact that the cap lid member must then be manually pivoted upwardly in order to obtain the open position and access to the contents of the container. This requirement for two dissimilar physical motions effectively precludes a child or other mentally infirm person from successfully operating the dispensing closure by demanding a degree of physical skill generally not found in individuals of this type. Additionally, the dispensing closure requires for its operation a two-step reasoning process that far exceeds the intellectual proficiency of children. A first alternative embodiment for the foregoing dispensing closure and container neck is shown in FIGS. 8, 9 and 10. The dispensing closure as illustrated therein is essentially identical to that disclosed in FIGS. 1–7 except that cap base member 112 is provided with an interior depending skirt 124 having first peripheral cap locking bead 131 for engaging a first peripheral container locking bead 135 for purposes of securing the cap base member to the neck 134 of a container. A second peripheral cap locking bead 132 is provided on the interior skirt above the first cap locking bead 131 for engagement with a second container locking bead 136 similarly provided on the container neck 134 above the first container locking bead 135.

The interior skirt 124 is provided with an interruption 126, at which point the interior skirt diverges into interior skirt portions 128 which merge with the exterior skirt 118. The length of the interruption 126 extending between skirt portions 128 is approximately equal to the length of the locking prong 150. The interruption 126 extends downwardly from the slot 130 to a point above the first cap locking bead 131 at which point the interior skirt is continuous. In other words, the first cap locking bead 131 is essentially continuous for engaging the first container locking bead 135, which is also essentially continuous, so as to provide maximum hoop strength for prohibiting removal of the cap base member from the neck of the container. The interior skirt above the engagement of the respective first cap and first container locking beads is discontinuous, however, being provided with an interruption 126 as was discussed in connection with interruption 26 of the preferred embodiment. The second container locking bead 136, as was also discussed in connection with container locking bead 36 of the preferred embodiment, is provided with an interruption 138, generally equal in length to the interruption 126 in the interior skirt. The interruption 138 is adapted to be aligned with the slot 130 formed in the cap base member. Thus, it is apparent that the first alternative embodiment, by providing an additional cap locking bead and container locking bead which are generally continuous, insures that the engagement of the dispensing closure with the neck of the container possesses maximum hoop strength such as to afford great resistance to whatever stresses or forces may be imposed upon the dispensing closure and to prohibit its removal from the container neck. The method and mode of operation for the embodiment of FIGS. 8–10 is identical to that previously discussed in connection with FIGS. 1–7. The locking prong 150 is configured, however, such that its length is generally equal to the depth of the interruption 126, above the continuous first cap and container locking beads, such that the hook-like end member 152 of the locking prong may engage under the second container locking bead 132.

Figure 11:
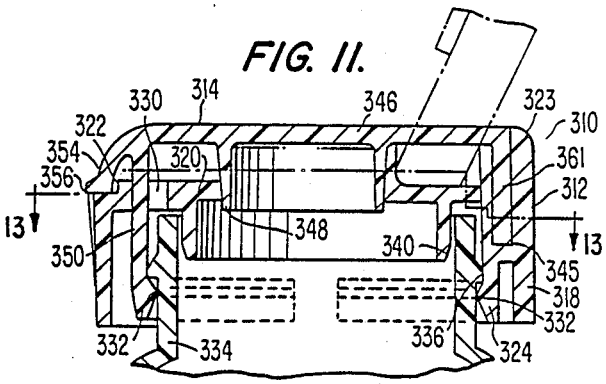
FIG. 11 is a side sectional view of a second alternative embodiment of the dispensing closure of applicant's co-pending application taken along line 11—11 of FIG. 12 and showing the dispensing closure in the fully closed and unlocked position.
Figure 12:
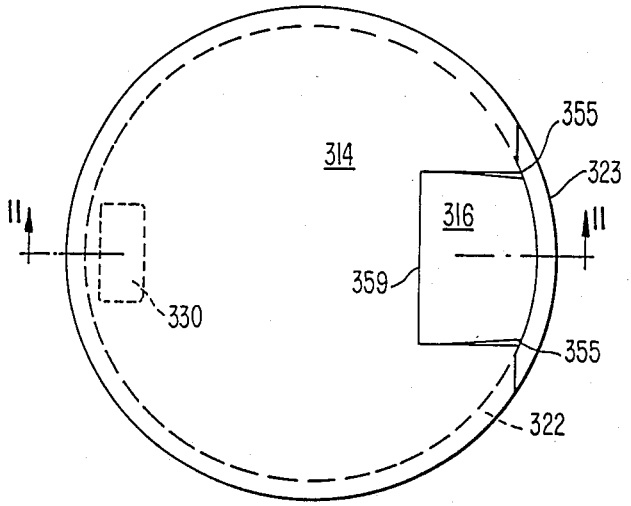
FIG. 12 is a top plan view of the dispensing closure of FIG. 11.
Figure 13:
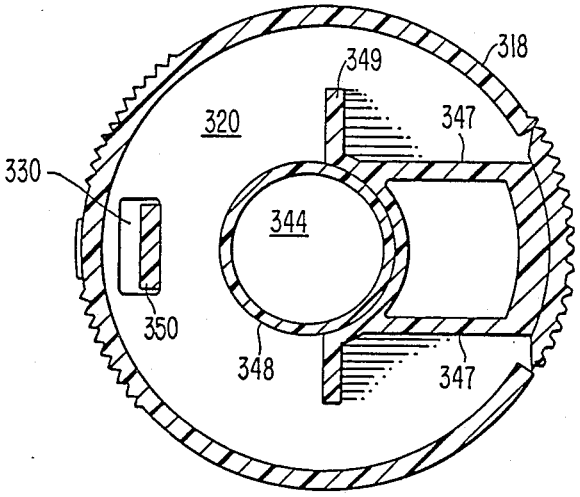
FIG. 13 is a top sectional view of the dispensing closure of FIG. 11 taken along line 13—13 and showing the dispensing closure in the fully closed and unlocked position.

FIGS. 11–13 depict a second alternative embodiment for the preceding type of child resistant dispensinng closure. The dispensing closure 310 comprises a cap base member 312 and a cap lid member 314. The cap lid member is preferably constructed so as to be integral with a spring 316. The cap lid member and the spring are integrally formed by known injection molding techniques. The cap lid member, the cap base member and the spring are formed of a somewhat flexible, somewhat resilient, polymer material.

The cap base member is defined by a first generally cylindrical exterior depending skirt 318 and a top surface 320. An annular recessed shoulder 322, shown in broken lines in FIG. 12, is provided around the periphery of the top surface between the top surface and the exterior skirt 318, being interrupted at the location of the back wall 323. Back wall 323 extends above the top surface and appears as an extension of the exterior skirt 318.

A second generally cylindrical interior depending skirt 324 extends downwardly from the top surface. This interior skirt is not continuous, however, but is provided with an interruption as was discussed in connection with the previous embodiments. A generally rectangular slot 330 is provided in the top surface 320 of the cap base member at the location of the interruption. The continuous portion of the interior skirt is provided with a peripheral locking bead 332 for frictionally engaging the peripheral container locking bead 336 provided on the neck 334 of a container. The container locking bead is similarly not continuous, being provided with an interruption as was discussed in connection with the preferred and the first alternative embodiments.

A dependent cylindrical sealing element 340 extends downwardly from the top surface interiorly of the interior skirt. A dispensing opening 344 is provided in the top surface, leading therethrough for communication with the interior of the container.

An elongated opening 345 is located in the top surface immediately adjacent the back wall 323. Two parallel ridges 347 extend from the extremeties of the opening 345 generally toward the dispensing opening 344. These ridges are connected by a straight or elongated wall or ridge 349 extending across the top surface.

The cap lid member 314 includes a substantially planar top 346 which carries a plug member 348 adapted to fit within the dispensing opening 344 so as to close off and seal the opening in the closed position of the dispensing closure. An integral resilient locking prong 350 extends from the interior surface of the planar top, generally perpendicular thereto, and terminates in a hook-like end member 352. The cap lid member is further defined by a cap skirt 354 having a lip 356. The cap skirt is dimensioned so as to abut the recessed shoulder 322 when the cap lid member is in the closed position shown in FIG. 11 and as hereinbefore discussed.

With reference to FIG. 12, the cap lid member includes two inwardly extending slots or cut-outs 355 which extend generally from a straight back edge on the planar top. These two slots extend along the spring 316 when the cap lid member is in a closed position. The spring 316 is a flat, leaf-type spring which is connected to the planar top along a line 359 of reduced cross-sectional thickness serving as a pivot so as to pivotally connect the cap lid member with the spring at one of the ends of the spring. The other end of the spring is formed integral with a mounting tab 361 which extends at a right angle to the spring. This tab 361 fits closely within the opening 345 so as to secure the cap lid member to the cap base member such that it may be moved between a closed position wherein the plug member 348 on the cap lid member is received within the dispensing opening 344 in the cap base member and locking prong 350 is fully received within slot 330 and engaged beneath the continuous portions of the container locking bead, to an open position wherein the dispensing opening is unobstructed.

The spring 316 serves to support the cap lid member at all times. In the closed position of the cap lid member, the spring 316 is unstressed and holds the line 359 serving as a pivot generally adjacent to the top surface. In this position, the cap lid member fits against the top surface 320 so as to close off the dispensing opening. Because of the engagement between the cap lid member and the top surface, the spring in effect biases the cap lid member in contact with the top surface so that it cannot be pivoted. In this position, the edge of the cap skirt 354 abuts the shoulder 322 on the cap base member and the locking prong 350 is fully received within the slot 330. The locked position for the dispensing closure is obtained when the hook-like end member of the locking prong is engaged under the continuous portion of the container locking bead as was discussed in connection with the embodiments of FIGS. 1–7 and FIGS. 8–10.

The cap lid member is adapted to be manipulated from the fully closed, locked position to an open position, shown in phantom in FIG. 11, by first manually rotating the dispensing closure with respect to the container neck so as to bring the slot into alignment with the interruption in the container locking bead, as indicated by the alignment of visible indicia, and then by manually moving the cap lid member generally upwardly so as to bend the spring 316. As the cap lid member is moved upwardly and as the spring is bent, the line 359 is elevated relative to the top surface 320 of the cap base member. As this occurs, the cap lid member may be pivoted to an open position relative to the spring and the top surface. The ridge 349 acts as a stop means engaging the cap lid member to limit the amount that the cap lid member may be rotated about the line 359 as the spring is deformed.

When the cap lid member is in contact with the ridge 349 it may be released and it will automatically remain in the open position in which the spring biases the lid member against the top surface and the ridge. The lid member will be held open until such time as it is manipulated to a closed position by pivoting the cap lid member relative to the line 359 a sufficient extent.

Figure 14:
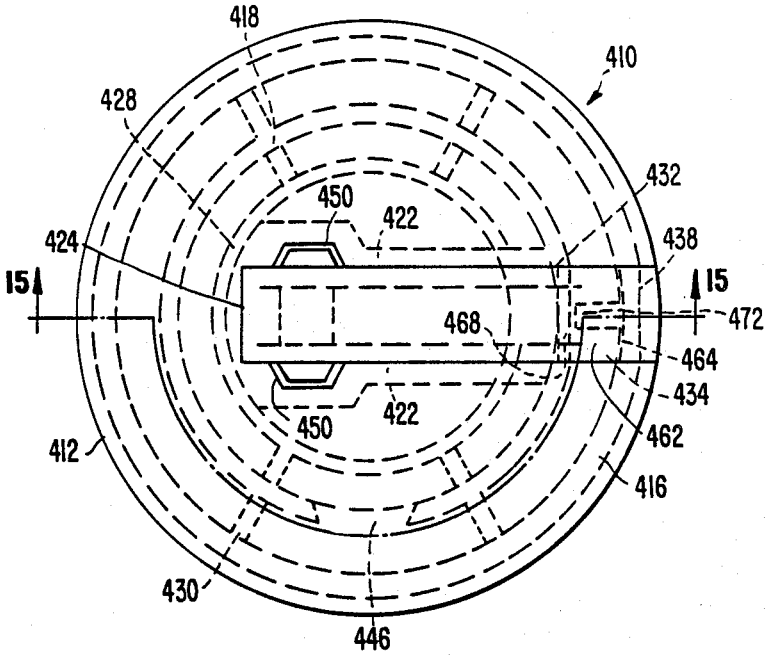
FIG. 14 is a top plan view of a dispensing closure of the present invention of the type characterized by a spout member which is rotatably mounted on a cap member.
Figure 15:
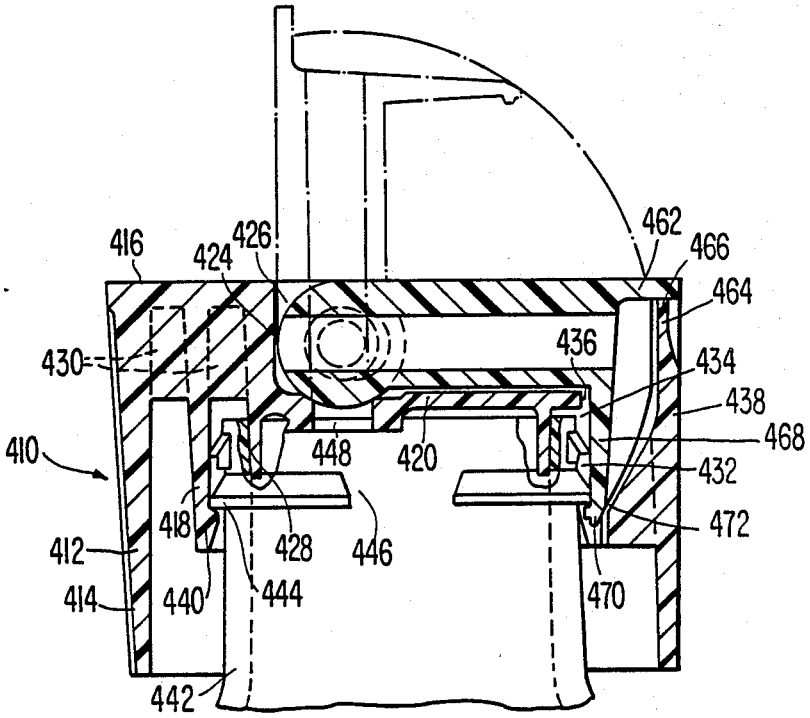
FIG. 15 is a side sectional view of the dispensing closure shown in FIG. 14 taken along line 15—15 of FIG. 14 and showing the dispensing closure in the fully closed and locked position.

The dispensing closure of the present invention incorporates the foregoing features into a dispensing closure of the type which is broadly characterized by a cap member and a spout member. The dispensing closure is depicted in FIGS. 14 and 15, wherein it can be seen that the closure 410 comprises a cap member 412 defined by a generally cylindrical exterior depending skirt 414 and a top surface 416. A first generally cylindrical interior depending skirt 418 extends downwardly from the top surface, being spaced from and concentric with exterior skirt 414.

The top surface is provided with a recessed flat portion 420 which is bounded by integrally formed parallel side walls 422 joined by a rear wall 424. The side and rear walls integrally connect the recessed portion to the top surface. Thus, the recessed portion, together with the side and rear walls, define an elongated groove 426 in the top surface of the cap member.

A second generally cylindrical interior depending skirt 428 extends downwardly from the recessed portion 420, spaced inside of and concentric with the first interior depending skirt 418. The exterior skirt 414, and the first and second interior skirts 418, 428, are provided with strengthening ribs 430. The first interior skirt 428 differs from the exterior skirt 414 and the second interior skirt 428 in that the exterior and second interior skirts are continuous, while the first interior skirt is not. Rather, the first interior skirt is interrupted at 432 at the location of the elongated groove. In particular, the recessed portion 420 and the first interior skirt are interrupted so as to form an open area 434 which extends between a terminal edge 436 of the recessed portion and the side wall 438 of the cap member, end 436 being located opposite the rear wall 424. Thus, the open area 434 forms a slot or opening in the elongated groove between the terminal edge of the recessed portion and the side wall of the cap member. The width of the open area 434 is defined by the distance between the parallel side walls 422 of the elongated groove. As can be seen in FIG. 15, the side wall 438 of the cap member is integral with the exterior skirt.

With particular reference to FIG. 15, the continuous portion of the first interior skirt is provided with means, in the form of a peripheral cap locking bead 440, for securing the first interior skirt to the neck 442 of a container. The cap locking bead is provided on the uninterrupted portion of the first interior skirt, thereby leaving the open area unobstructed. The neck 442, which may be formed integral with a bottle or container, or which may be formed separately therefrom, is provided with a peripheral container locking bead 444. The container locking bead is adapted to engage the cap locking bead for purposes of positively and frictionally securing the cap member upon the neck of the container, while allowing the cap member to be rotated with respect to the neck. The container locking bead is able to protrude through the interruption formed in the first interior skirt.

FIG. 15 depicts in section the cap member 412 as it appears when secured to the neck 442. As shown therein, the container locking bead is also not continuous, being provided with an interruption 446, generally equal in width to the width of the open area 434. Additionally, it can be seen that the second interior skirt is adapted to be sealingly received within the opening in the neck of the container and, as such, may be provided with means suitable for engaging the inside of the neck of the container.

It should be noted that other similar known means may be utilized instead of the locking beads for mounting the cap base member upon the neck of the container.

A vertically directed cylindrical opening 448 extends through the recessed portion 420 remote from the terminal edge 436 and proximate the rear wall 424. This opening leads into what may be referred to as the interior of the cap member, which opening, when the cap member is mounted on the neck of the container, communicates with the interior of the container. Aligned conventional bearing cavities 450 are located in the side walls 422 so as to face each other. These bearing cavities having a common horizontally extending axis (not shown) which is located so as to intersect the vertically extending axis (not shown) of the opening 448.

As is further evident from FIG. 15, the top of the spout member, when in the closed position of FIG. 15, is generally flush with the top surface 416 of the cap member. In order to effectively close off and seal the open area 434 provided in the cap member, the second end of the spout member is provided with an extension 462. Extension 462 overlies an indented portion 464 formed in the side wall 438 of the cap member at the location of the open area 434. The indented portion 464 terminates in an upper edge 466 which is slightly lower than the top surface of the cap member so that the extension on the spout member may be supported by the upper edge while maintaining a flush surface for the top of the spout and cap member when the spout is in the closed position. The tip of the extension, which protrudes beyond the upper edge 466 due to the indented portion 464, allows the tip of the spout member to be manually grasped. The spout member, in the closed position, closes off the cap member so as to minimize exposure of the interior of the cap member and the container to ambient air.

The spout member, as shown in FIG. 15, is further provided with an integral locking prong 468 which depends generally vertically from the bottom surface of the spout member and which terminates in a hook-like end member 470. The locking prong is located on the spout member proximate its second end such that the prong is received within the open area 434 provided in the cap member when the closed position of FIG. 15 is established for the dispensing closure. The open area, in conjunction with the interruption 432 in the first interior skirt, permits the locking prong to be fully inserted into the cap member. The latter closed position is able to be achieved when the interruption 446 on the container locking bead 444 is brought into alignment with the open area. This alignment is capable of being brought about by a user manually rotating the cap member with respect to the neck of the container so that the interruption in the container locking bead is vertically aligned with the open area. The latter position allows the locking prong to pass through the open area and the aligned interruption in the container locking bead. In the case of the embodiment depicted in FIG. 15, the aligned position corresponds to alignment of the extension of the spout with the interruption in the container locking bead.

From the foregoing closed position, the dispensing closure is adapted to assume a closed and locked position by the user manually rotating the cap member with respect to the neck of the container until the interruption in the container locking bead is not aligned with the open area, but rather, a continuous portion of the container locking bead protrudes through the interruption in the first interior skirt. It should be noted that the aligned and non-aligned positions for the container locking bead and the open area may be suitably indicated by providing suitable indicia on the exterior of the cap member and/or the neck of the container. The closed and locked position for the dispensing closure is shown in FIG. 15, wherein it can be seen that the interruption in the container locking bead is not aligned with the open area, but rather, a continuous portion of the container locking bead is aligned with the open area in the cap member. Thus, the hook-like end member 470 of the locking prong is lockingly engaged with the portion of the container locking bead which protrudes through the interruption in the skirt. The hook-like end member on the locking prong is urged into engagement with the container locking bead by means of an inwardly extending flange 472 provided on the inside surface of the side wall of the cap member adjacent the open area. The locking engagement between the spout member and the neck of the container, upon which the container locking bead is provided, positively prevents the spout member from being inadvertantly moved from the closed position.

From the closed and locked position of FIG. 15, the dispensing closure is capable of achieving a fully open position for dispensing of the contents of the container. The open position is accomplished by the user manually rotating the cap member with respect to the neck of the container to once again align the open area with the interruption in the container locking bead. The hook-like end of the locking prong will, in the latter position, be disengaged from the container locking bead, with the dispensing closure being in a closed but unlocked position. Realization of the fully open position may then be accomplished from the closed but unlocked position by the user manually grasping the tip of the extension on the spout member and rotating the spout member in an upward direction with respect to the cap member. Rotation of the spout member to a vertical position, wherein the longitudinal passage formed in the spout member is aligned with the opening formed in the cap member, corresponds to the fully open position for the dispensing closure. In the fully open position, the contents of the associated container are able to be dispensed through the aligned opening and passage.

While the instant invention has been described with a degree of particularity in connection with a preferred embodiment, it should be understood that the foregoing disclosure is made by way of example and that many variations and modifications of the details of construction and combination and arrangement of parts herein described will be obvious to those skilled in the art and may be adopted without departing from the spirit and scope of the invention as defined in the appended claims.

What is claimed is:

1. A child resistant dispensing closure comprising a cap member and a spout member, said cap member being defined by a top surface, a peripheral side wall, an exterior depending skirt, and an interior depending skirt, an elongated recessed groove formed in said top surface, said groove having a first end and a second end, a dispensing opening formed in said groove proximate said first end and communicating with the interior of said cap member, an open area formed in said groove proximate said second end, aligned bearing cavities provided in said groove, said interior skirt being interrupted at the location of said open area, cap locking means provided on said interior skirt, said cap locking means being adapted to engage container locking means provided on the neck of a container, said container locking means being provided with an interruption, said cap member being adapted for rotation with respect to said neck, said spout member being defined by an elongate body having a first end and a second end, said first end of said spout member being provided with trunions, said trunions being adapted to be received within said bearing cavities for rotatably mounting said spout member within said groove, a longitudinal dispensing passage formed in said spout member, a depending locking prong provided on said spout member, said spout member being adapted for movement with respect to said cap member from an open position wherein said dispensing opening and said dispensing passage are aligned to a closed and locked position wherein said spout member closes off and seals said dispensing opening by a user manually aligning said interruption in said container locking means with said open area, rotating said spout member toward said cap member so as to cause said locking prong to enter said open area and said interruption in said container locking means, rotating said cap member with respect to said neck so that said interruption and said open area are no longer aligned, said locking prong then being engaged with said neck.

2. The child resistant dispensing closure recited in claim 1 further comprising locating means on said cap member and on said neck identifying said aligned position of said open area and said interruption.

3. The child resistant dispensing closure recited in claim 1 wherein said locking prong is provided with a hook-like end member, said end member being adapted to be engaged with said container locking means in said closed and locked position.

4. The child resistant dispensing closure recited in claim 1 wherein said groove is defined by a recessed portion, a pair of side walls and a rear wall, said recessed portion opposite said rear wall terminating in a terminal edge.

5. The child resistant dispensing closure recited in claim 4 wherein said dispensing opening is formed in said recessed portion.

6. The child resistant dispensing closure recited in claim 4 wherein said bearing cavities are formed in said side walls of said groove.

7. The child resistant dispensing closure recited in claim 4 wherein said open area extends between said terminal edge and said side wall of said cap member.

8. The child resistant dispensing closure recited in claim 1 wherein said second end of said spout member is provided with an extension.

9. The child resistant dispensing closure recited in claim 1 wherein said side wall of said cap member at the location of said open area is provided with an indented portion, said indented portion terminating in an upper edge, said upper edge being lower than said top surface of said cap member so that said extension overlies said upper edge when said spout member is in said closed position.

10. The child resistant dispensing closure recited in claim 1 wherein said side wall adjacent said open area is provided with an internal extension flange, said flange being adapted to urge said locking prong into engagement with said neck of said container in said closed and locked position of said spout member.

11. A child resistant dispensing closure comprising a cap member and a spout member, said cap member being defined by a top surface, a peripheral depending skirt forming a side wall for the cap member, at least one interior depending skirt, a recessed portion formed in said top surface and connected thereto by a pair of spaced side walls and a rear wall, said recessed portion and said side and rear wall defining an elongated groove in said top surface, said recessed portion terminating in a terminal edge opposite said rear wall, a bearing cavity provided in each of said side walls, said bearing cavities being aligned, said aligned bearing cavities having a horizontal axis, a dispensing opening formed in said recessed portion and having a vertical axis, said vertical axis intersecting said horizontal axis, an open area formed in said groove and extending between said terminal edge and said side wall of said cap member, said interior skirt being interrupted at the location of said open area, said open area having a width as measured by the distance between said spaced side walls, a cap locking bead provided on said interior skirt, said cap locking bead being adapted to engage a container locking bead provided on the neck of a container, said container locking bead being provided with an interruption and a continuous portion, said cap member being adapted for rotation with respect to said neck, said spout member being defined by an elongate body having a first end, a second end, and a top and bottom surface, trunions provided on said first end, said trunions being adapted to be received within said bearing cavities for mounting said spout member within said groove for rotation with respect to said cap member, a longitudinal dispensing passage formed in said spout member, a depending locking prong provided on said bottom surface of said spout member, said spout member being adapted to assume an open position wherein said spout member is oriented vertically with respect to said cap member and said dispensing opening and said longitudinal passage are aligned, said spout member being adapted to assume a closed position from said open position by manually aligning said interruption in said container locking bead with said open area and rotating said spout member downwardly toward said cap member so that said locking prong is received within said open area and said interruption in said container locking bead, said alignment being adapted to be achieved by manually rotating said cap member with respect to said neck so as to vertically align said interruption in said container locking bead and said open area, said spout member being adapted to assume a closed and locked position from said closed position by manually further rotating said cap member with respect to said neck so that said interruption and said open area are in a non-aligned position, said non-aligned position being characterized by said continuous portion of said container locking bead being aligned with said open area and said locking prong being engaged with said continuous portion.

12. The child resistant dispensing closure recited in claim 11 wherein said locking prong is provided with a hook-like end member adapted to engage said container locking bead.

13. The child resistant dispensing closure recited in claim 11 further comprising locating means on said cap member and on said neck identifying said aligned position of said open area and said interruption.

14. The child resistant dispensing closure recited in claim 11 wherein said second end of said spout member is provided with an extension.

15. The child resistant dispensing closure recited in claim 14 wherein said side wall of said cap member at the location of said slot is provided with an indented portion, said indented portion terminating in an upper edge, said upper edge being lower than said top surface of said cap member so that said extension overlies said upper edge when said spout member is in said closed position.

16. The child resistant dispensing closure recited in claim 15 wherein said top surface of said spout member is substantially flush with said top surface of said cap member when said spout member is in said closed position.

17. The child resistant dispensing closure recited in claim 11 wherein said side wall adjacent said open area is provided with an internal extension flange, said flange being adapted to urge said locking prong into engagement with said container locking bead in said closed and locked position of said spout member

* * * * *